United States Patent [19]

Nakamura

[11] 4,250,781

[45] Feb. 17, 1981

[54] APPARATUS FOR CUTTING OFF A PAIR OF SLIDE FASTENER STRINGERS

[75] Inventor: Hiroshi Nakamura, Higashi, Japan

[73] Assignee: Yoshida Kogyo, K.K., Tokyo, Japan

[21] Appl. No.: 29,871

[22] Filed: Apr. 13, 1979

[30] Foreign Application Priority Data

Apr. 28, 1978 [JP] Japan ..... 53-51131

[51] Int. Cl.[3] ..... B26D 5/28

[52] U.S. Cl. ..... 83/210; 83/211; 83/222; 83/277; 83/364; 83/371; 83/921

[58] Field of Search ..... 83/42, 209, 210, 211, 83/212, 222, 277, 364, 371, 921

[56] References Cited

U.S. PATENT DOCUMENTS 3,776,078 12/1973 Perlmann ..... 83/921 X 4,043,232 8/1977 Jovin ..... 83/921 X

*Primary Examiner*—J. M. Meister

*Attorney, Agent, or Firm*—Robert E. Burns; Emmanuel J. Lobato; Bruce L. Adams

[57] ABSTRACT

A pair of interlocked slide fastener stringers having a plurality of sliders respectively on their longitudinally spaced chains of coupling elements fed over a guide table as the sliders are sensed one at a time by a feeler lever pivotally mounted on the guide table. A stop lever pivotable with respect to the guide table has a stop finger that projects into one of element-free spaces between the chains in response to the pivotal movement of the feeler lever due to engagement thereof with the slider. The stop finger, while not actuated, is withdrawn out of the way, and thus does not interfere with the sliders moving with the slide fastener stringers.

7 Claims, 4 Drawing Figures

APPARATUS FOR CUTTING OFF A PAIR OF SLIDE FASTENER STRINGERS

BACKGROUND OF THE INVENTION

1. Field of the Invention

The present invention relates to a method of and an apparatus for cutting off a pair of slide fastener stringers across element-free spaces between a plurality of coupling element chains with sliders mounted respectively thereon.

2. Prior Art

Conventional slide fastener cutting machines have a vertically movable stop finger against which longitudinally spaced chains of interengaged coupling elements are slidable. When an element-free space in the chain arrives, the stop finger projects into the space and engages the end of an adjacent chain, whereupon the sliding clasp fastener stringers are stopped for a cutting operation. A form of such stop finger is disclosed in U.S. Pat. No. 2,302,910, patented Nov. 24, 1942.

However, the prior stop finger fails to function properly on such chains of coupling elements having sliders mounted respectively thereon since the stop finger as slid on the chains gets in the way of the sliders.

SUMMARY OF THE INVENTION

According to a method of the present invention, the sliders on longitudinally spaced chains of coupling elements in a pair of interlocked slide fastener stringers is sensed one at a time while the stringers are being moved, and then, in response to such slider sensing, the element-free spaces between the chains are sensed one at a time to stop the slide fastener stringers for severing them across the sensed element-free space. An apparatus for carrying out the method comprises means on a stringer guide table for sensing one of the sliders at a time and means on the guide table for sensing one of the element-free spaces at a time in response to the actuation of the slider sensing means, so as to stop the sliding clasp fastener stringers preparatory to cutting off them across the sensed element-free space. The slider sensing means comprises a feeler lever pivotally mounted on the guide table and normally urged against the stringer chains as they progress over the guide table, and the space sensing means comprises a stop lever pivotally supported with respect to the guide table and having a stop finger which projects into the element-free space when the stop lever is actuated by a solenoid in response to the pivotal movement of the feeler lever due to engagement thereof with the slider.

It is an object of the present invention to provide a method of and an apparatus for cutting off a pair of interlocked slide fastener stringers with sliders respectively mounted on longitudinally spaced chains of coupling elements.

Another object of the present invention is to provide an apparatus for cutting off a pair of interlocked slider fastener stringers, the apparatus having a stop finger for reliably projecting into one of element-free spaces in the stringers at a time to stop the advancing movement thereof.

Many other advantages, features and additional objects of the present invention will become manifest to those versed in the art upon making reference to the detailed description and the accompanying drawings in which a preferred embodiment incorporating the principles of the present invention is shown by way of illustrative example.

DETAILED DESCRIPTION

Figure 1:
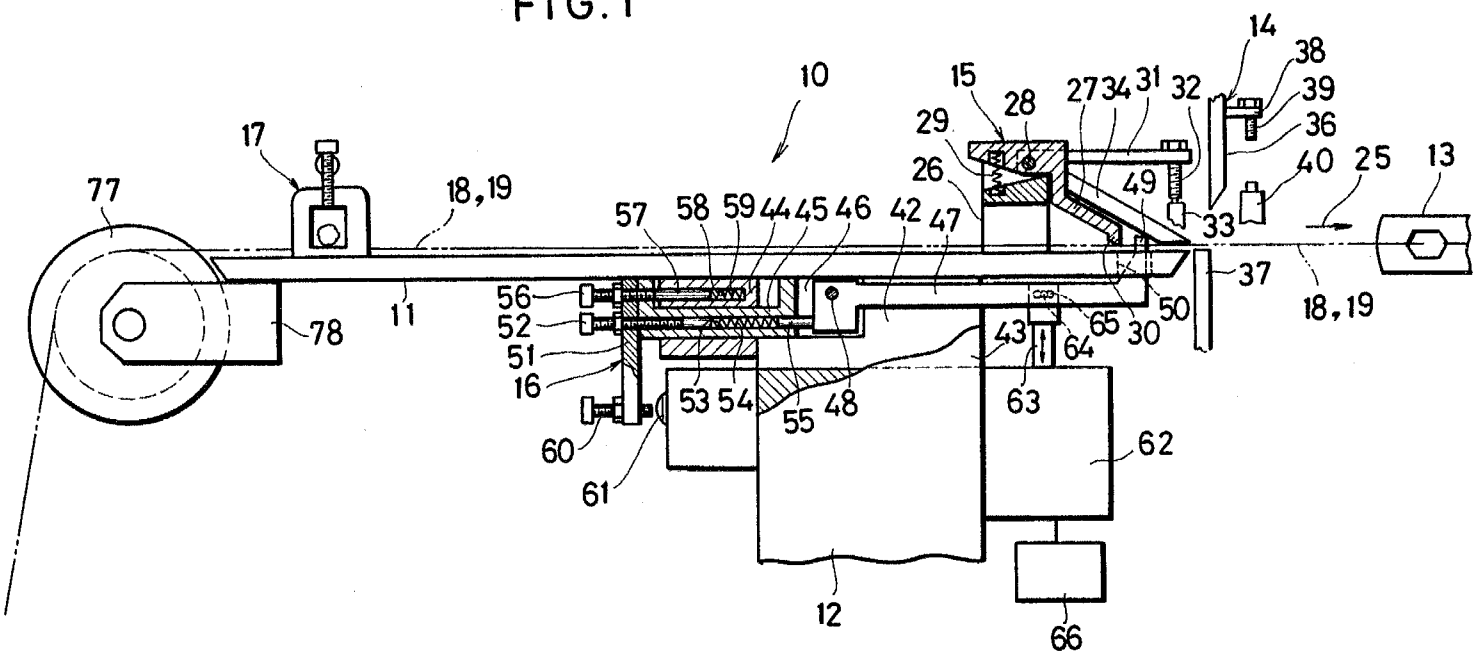
FIG. 1 is a schematic side elevational view of a cutting apparatus constructed in accordance with the present invention.

The principles of the present invention are particularly useful when embodied in a cutting apparatus such as shown in FIG. 1, generally indicated by the numeral 10.

The cutting apparatus 10 generally comprises a horizontal guide table 11 supported on a base 12, a grip 13 located adjacent to one end of the guide table 11 and reciprocally movable toward and away from the guide table 11, a cutter 14 disposed near said one end of the guide table 11, a slider sensor 15 mounted on the guide table 11 at said one end thereof, a space sensor 16 disposed beneath the guide table 11, and a slider holder 17 mounted on the guide table 11 at the other end thereof.

Figure 3:
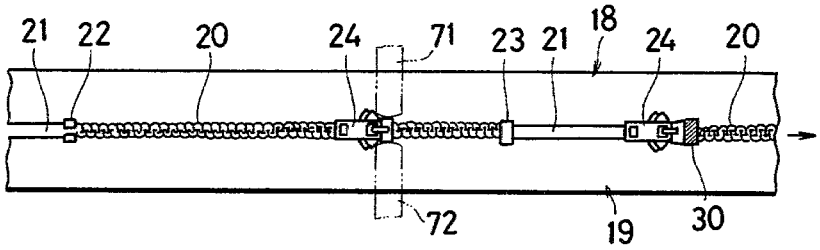
FIGS. 3 through 5 are views progressively showing the method of cutting off a pair of slide fastener stringers.

In FIG. 3, a pair of slide fastener stringers 18, 19 to be severed on the cutting apparatus 10 are interlocked and include a plurality of longitudinally spaced chains 20 of two rows of interengaged coupling elements with a plurality of element-free gaps or spaces 21 disposed between the chains 20. Each of the chains 20 has a top end stop 22 secured at one end and a bottom end stop 23 secured at the other end. A plurality of sliders 24 for taking the rows of coupling elements into and out of mutual engagement are slidably mounted respectively on the coupling element chains 20. As shown in FIG. 1, the slide fastener stringers 18, 19 are intermittently fed by the grip 13 over the guide table 11 in the direction of the arrow 25 from the slider holder 17 via the slider sensor 15 toward the cutter 14.

The slider sensor 15 includes a support 26 mounted on the guide table 11 and a feeler lever 27 pivotally mounted on the support 26 by means of a pin 28, there being a compression coil spring 29 acting between the support 26 and the feeler lever 27 for normally urging the feeler lever 27 in a direction to force its lever end 30 downwardly against the chains 20 of the slide fastener stringers 18, 19 being fed over the guide table 11. A horizontal rod 31 extends from the feeler lever 27 and carries on its distal end a switch actuator bolt 32 which normally engages a microswitch 33. Extending obliquely downwardly from the support 26 toward the end of the guide table 11 is a stringer presser 34 for holding down the slide fastener stringers 18, 19 against the guide table 11.

The cutter 14 comprises an upper movable blade 36 and a lower fixed blade 37 located downwardly of the upper movable blade 36, the slide fastener stringers 18, 19 being movable between the movable and fixed blades 36, 37. The movable blade 36, when moved downwardly, coacts with the fixed blade 27 to sever the slide fastener stringers 18, 19. A horizontal rod 38 is attached to the movable blade 36 and supports thereon a switch actuator bolt 39, which is engageable with a limit switch 40 for energization thereof when the movable blade 36 is lowered and cuts off the slide fastener stringers 18, 19 by coaction with the fixed blade 37.

The base 12 has a pair of upwardly extending arms 42, 43 laterally spaced from each other and supporting a guide block 44 extending therebetween, the guide block 44 being fixed with respect to and located beneath the guide table 11. A slide 45 extends horizontally through the block 44 and is slidable relatively to the block 44. The slide 45 has a pair of horizontally spaced brackets 46 (only one shown in FIG. 1) to which there is pivotally mounted by a pin 48 a horizontal stop lever 47 disposed beneath the guide table 11. The stop lever 47 includes at its distal end a stop finger 49 which projects upwardly through a slot 50 in the guide table 11. The stop finger 49 is located behind the lever end 30 of the feeler lever 27 in the direction in which the slide fastener stringers 18, 19 are moved. The stop lever 47 is pivotable or angularly movable up and down about the pin 48 to cause the stop finger 49 to project upwardly beyond the guide table 11 and to be withdrawn downwardly into the slot 50.

A vertical switch actuator rod 51 is attached to the slide 45 by means of a bolt 52 extending threadedly into a through hole 53 in the slide 45, there being a compression coil spring 54 and a pin 55 slidably placed in the hole 53. The spring 54 acts between the bolt 52 and the pin 55, an end of the pin 55 which projects out of the hole 53 acting on the stop lever 47 at a position below the pivot pin 48 so as to give the stop lever 47 a tendency to pivot upwardly. There is another bolt 56 extending threadedly through the vertical rod 51 and the slide 45, with a non-threaded end portion 57 of the bolt 56 being disposed slidably in a blind hole 58 in the block 44. A compression coil spring 59 is placed in the blind hole 58 and acts on the non-threaded end portion 57 for normally urging the slide 45 in a direction to keep an actuator bolt 60 on the rod 51 away from a microswitch 61 mounted on the base 12. The microswitch 61 is wired in circuit with a control (not shown) for the grip 13, and when actuated, stops the feeding motion of the grip 13.

A solenoid 62 is mounted on the base 12 and includes a vertical plunger 63 having a pin 64 loosely received in a horizontal slot 65 in the stop lever 47, the stop lever 47 being horizontally movable with respect to the plunger 63 through the pin-and-slot connection. The solenoid 62, when energized, enables the stop lever 47 to pivot upwardly about the pin 48 for bringing the stop finger 49 upwardly beyond the guide table 11. The solenoid 62 is wired, for de-energization, in circuit with the limit switch 40. The solenoid 62 is energized under the control of a time switch 66, which is wired in circuit with the microswitch 33.

Figure 2:
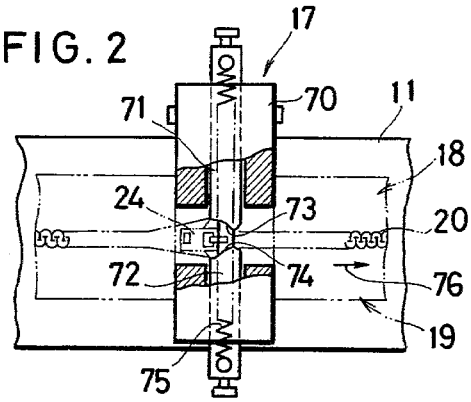
FIG. 2 is an enlarged plan view of a slider holder in the apparatus.

As shown in FIG. 2, the slider holder 17 comprises a housing 70 mounted on the guide table 11, a pair of horizontal fingers 71, 72 slidably mounted in the housing 70 and having a pair of confronting grip surfaces 73, 74, respectively, for jointly gripping one of the sliders 24 at a time therebetween, and a tension spring 75 acting between the fingers 71, 72 to normally bias them toward each other. As the slide fastener stringers 18, 19 are moved along in the direction of the arrow 76, the slider 24 is caught by the finger grip surfaces 73, 74 and remains gripped therebetween until the slider 24 is engaged by the top end stop 22, whereupon the advancing movement of the slide fastener stringers 18, 19 causes the slider 24 to be forced with the top end stop 22 past the fingers 71, 72. Therefore, the sliders 24 mounted on the chain 20 become displaced one by one against the top end stops 22 as the slide fastener stringers 18, 19 progress beyond the slider holder 17.

In FIG. 1, a roller 77 is idly rotatably mounted by a bracket 78 on the guide table 11 adjacent to the slider holder 17. The slide fastener stringers 18, 19 while being fed are guided around the roller 77 onto the guide table 11.

Figure 4:
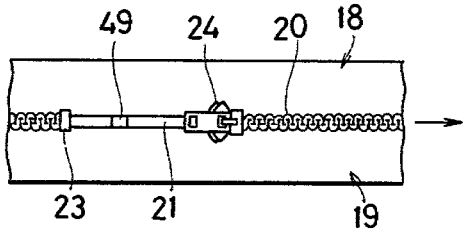

While the slide fastener stringers 18, 19 are being fed along, each slider 24 is displaced into contact with and held against a corresponding one of the top end stops 22 in the slider holder 17 (FIG. 3). The progressive movement of the stringers 18, 19 causes one of the sliders 24 to engage and raise the lever end 30 of the feeler lever 27, whereupon the feeler lever 27 pivots upwardly thereby de-energizing the microswitch 33 to set the time switch 66. The time switch 66, a predetermined interval of time after its setting, energizes the solenoid 62 to move the plunger 63 upwardly, at which time the stop lever 47 is lifted to cause its stop finger 49 to project upwardly beyond the guide table 11. The interval of time delay is selected such that the stop finger 49 enters the space 21 after the slider 24 which actuated the feeler lever 27 has moved past the stop finger 49 (FIG. 4).

Figure 5:
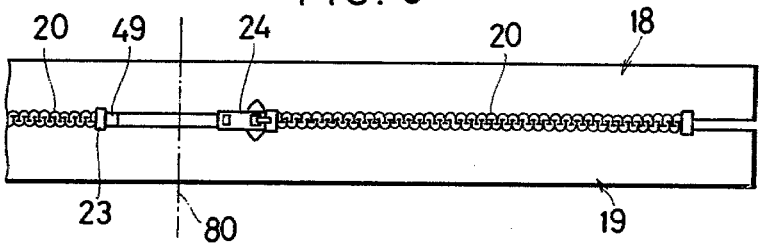

The stop finger 49 is then engaged by the bottom end stop 20 (FIG. 5) and is forced to move forward by the advancing movement of the slide fastener stringers 18, 19. The stop lever 47 and hence the slide 45 are accordingly pulled forward against the force of the spring 59 until the microswitch 61 is energized by the actuator bolt 60, whereupon the grip 13 is caused to stop. Then, the movable blade 36 is lowered to sever the slide fastener stringers 18, 19 along the dot-and-dash line 80 (FIG. 5). Upon cutting-off of the stringer 18, 19, the limit switch 40 is energized by the actuator bolt 39, thereby de-energizing the solenoid 62. The plunger 63 is pulled back to withdraw the stop finger 49 downwardly from engagement with the bottom end stop 23 into the slot 50, whereupon the stop lever 47 and the slide 45 are retracted under the bias of the spring 59 to move the actuator bolt 60 away from the microswitch 61.

Although various minor modifications may be suggested by those versed in the art, it should be understood that I wish to embody within the scope of the patent warranted hereon, all such embodiments as reasonably and properly come within the scope of my contribution to the art.

What is claimed is:

1. An apparatus for cutting off a pair of interlocked fastener stringers including a plurality of longitudinally spaced chains of coupling elements with a plurality of sliders mounted respectively thereon, there being a plurality of element-free spaces between the longitudinally spaced chains, said apparatus comprising:

a guide table for supporting the slide fastener stringers thereon;

means for feeding the slide fastener stringers longitudinally over said guide table;

slider sensing means on said guide table for sensing one of the sliders at a time;

space sensing means on said guide table for sensing one of the element-free spaces at a time in response to the actuation of said slider sensing means, so as to stop the slide fastener stringers;

means for cutting off the slide fastener stringers across said one of the spaces upon stoppage of said slide fastener stringers;

said slider sensing means comprising a support mounted on said guide table;

a feeler lever pivotally mounted on said support;

spring means acting between said support and said feeler lever for normally biasing said feeler lever against the slide fastener stringers;

switch means actuatable in response to pivotal movement of said feeler lever due to engagement thereof with said one of said sliders;

said space sensing means comprising a stop lever pivotable with respect to said guide table;

stop lever actuating means for actuating said stop lever;

said stop lever having means insertable into said one of the spaces in response to the energization of said stop lever actuating means; and a time switch for energizing said stop lever actuating means a predetermined interval of time after the actuating of said switch means.

2. An apparatus according to claim 1, said cutting means comprising a fixed blade and a movable blade between which the slide fastener stringers are movable, and switch means energizable in response to the coaction of said movable blade with said fixed blade to cut off the slide fastener stringers, said space sensing means being de-energizable in response to the actuation of said switch means.

3. An apparatus according to claim 1, for cutting off a pair of interlocked slide fastener stringers with a pair of end stops mounted on the ends of each chain, further including means on said guide table for holding one of the sliders at a time against one of the end stops on corresponding one of the chains.

4. An apparatus according to claim 3, said slider holding means comprising a housing mounted on said guide table, a pair of spaced fingers slidably mounted in said housing for jointly gripping said one of the sliders therebetween, and spring means normally biasing said fingers toward each other.

5. An apparatus according to claim 1, said space sensing means further including slide means slidable with respect to said guide table, said stop lever being pivotally mounted on said slide means, said slide means being slidable when said stop means engages said one end of the chain, and actuator means on said slide means for acting on said switch means in response to the sliding movement of said slide means.

6. An apparatus according to claim 5, said space sensing means further including spring means acting on said slide means for normally urging said actuator means away from said switch means.

7. An apparatus according to claim 6, said space sensing means further including a block fixed with respect to said guide table, said slide means being slidably supported by said block, said spring means acting between said block and said slide means.

* * * * *